US005423493A

United States Patent [19]

Rueth et al.

[11] Patent Number: 5,423,493

[45] Date of Patent: Jun. 13, 1995

[54] METHOD FOR OPERATING AN AUTOMATIC BOBBIN-WINDING MACHINE DURING BATCH CHANGING OPERATIONS

[75] Inventors: Gregor Rueth; Michael Kery; Rolf Mayer; Helmuth Hensen, all of Moenchengladbach, Germany

[73] Assignee: W. Schlafhorst AG & Co., Moenchengladbach, Germany

[21] Appl. No.: 111,897

[22] Filed: Oct. 8, 1993

[30] Foreign Application Priority Data

Oct. 8, 1992 [DE] Germany ..... 42 33 819.0

[51] Int. Cl.[6] ..... B65G 47/46; B65H 67/06; D01H 9/18

[52] U.S. Cl. ..... 242/35.5 A; 57/90; 57/281

[58] Field of Search ..... 242/35.5 A, 35.5 R; 57/281, 90

[56] References Cited

U.S. PATENT DOCUMENTS

| | | | |
|---|---|---|---|
| 4,544,107 | 10/1985 | Matsui et al. | 242/35.5 A |
| 4,809,919 | 3/1989 | Ueda et al. | 242/35.5 AX |
| 4,856,723 | 8/1989 | Tone | 242/35.5 A |
| 4,913,373 | 4/1990 | Ueda | 242/35.5 A |
| 5,056,725 | 10/1991 | Wirtz et al. | 242/35.5 A |
| 5,190,136 | 3/1993 | Grecksch et al. | 242/35.5 AX |
| 5,323,979 | 6/1994 | Grecksch et al. | 242/35.5 A |

FOREIGN PATENT DOCUMENTS

| | | |
|---|---|---|
| 3733788A1 | 4/1988 | Germany . |
| 3843553A1 | 7/1990 | Germany . |
| 4030861 | 9/1990 | Germany . |
| 3919542A1 | 12/1990 | Germany . |
| 4034824A1 | 5/1992 | Germany . |
| 4131608A1 | 3/1993 | Germany . |
| 4210815A1 | 10/1993 | Germany . |

*Primary Examiner*—Daniel P. Stodola
*Assistant Examiner*—William Stryjewski
*Attorney, Agent, or Firm*—Shefte, Pinckney & Sawyer

[57] ABSTRACT

A method of handling the tube and cop supporting pallets in a textile winder during batch changing operations, by which, at the end of a batch, the pallets are maintained in the transport system of the winder and are conveyed from the tube return path to the cop supply path. First, the winding operation is stopped, a selected winding station at one end of the distribution segment is evacuated to facilitate clearing therethrough of the distribution segment and, subsequently, the other winding stations are successively evacuated to release the pallets held in their respective unwinding and backup positions. Downstream along the tube return path, the cops or tubes are removed from all approaching pallets, regardless of whether they still carry any yarn. The resulting empty pallets are guided from the cop supply path around the end of the bobbin-winding machine, accumulated at the upstream end of the tube return path, and released only after they can no longer interfere with the successive evacuation of the pallets from the winding stations onto the tube return path.

8 Claims, 1 Drawing Sheet

METHOD FOR OPERATING AN AUTOMATIC BOBBIN-WINDING MACHINE DURING BATCH CHANGING OPERATIONS

FIELD OF THE INVENTION

The present invention relates to a method for operating an automatic bobbin-winding machine-during batch changing of the supply of cops to the machine.

BACKGROUND OF THE INVENTION

Automatic bobbin-winding machines typically have an automatic system for transporting cops and tubes to and from the winding stations of the machine, which can have a plurality of transport loops for circulating the cops and tubes. The transport loops extend partially over common transport paths. In this case, the cops and tubes can be placed on supporting pallets, sometimes referred to as peg trays. A transport system of this type is disclosed in German Patent DE 39 19 542 A1, for example.

Departing from a transport system of this type, German Patent Application P 41 31 608.8 describes a method for operating a bobbin-winding machine of this type during batch changing. At the end of a batch, when the bobbin-winding machine is no longer supplied with cops, the pallets with empty tubes remain in the transport system of the bobbin-winding machine, and are again conveyed from the tube return path to the cop supply path of the transport system.

SUMMARY OF THE INVENTION

It is an object of this invention to provide an improvement of the method of German Patent Application P 41 31 608.8 with respect to controlling the pallets during batch changing.

Briefly summarized, the present invention accomplishes this objective by a novel method for operating an automatic bobbin-winding machine during batch changing operations. Basically, the method is applicable to essentially any bobbin winding machine having a plurality of winding stations and a transport system for conveying cops and tubes to and from the winding stations, wherein the transport system comprises a plurality of transport loops having partially common transport paths for conveying cops and tubes while mounted upstanding on pallets, including a cop supply path, a cop distribution segment extending along the winding stations, and a tube return path. Under the present method, when the bobbin-winding machine has exhausted its supply of cops at the end of winding a batch of cops, the pallets are maintained in the transport system of the bobbin-winding machine and are conveyed from the tube return path to the cop supply path. The winding operation is stopped, all pallets are evacuated from a selected winding station at one end of the distribution segment, the distribution segment is cleared of pallets by transporting the pallets through the evacuated winding station, the other winding stations are evacuated successively of all the pallets thereat, and, at a location downstream of the tube return path, the cops or tubes are removed from all pallets.

After the end of the batch, depending on the selected mode of the batch, a greater or lesser number of cops and residual cops may remain in the transport system that cannot initially be respooled. This condition arises when a preset batch size has been attained, for example. In this case, the operational mode at the end of the batch may either be an immediate termination of the batch or to complete the production at the winding stations of as many full yarn packages, commonly referred to as cheeses, as possible. A standard practice in use for a number of years is to shut off the cheese changer of the machine after a preset number of changed cheeses has been attained whereby the winding stations successively cease their activity as they complete the production of full cheeses.

After complete termination of operation, the winder is enabled, via the evacuation of one or more winding station at the downstream end of the distribution segment that supplies the winding stations with cops, to clear the distribution segment, after which, the successive evacuation of the other winding stations enables the residual cops and remnant cops present thereat to also be conveyed to the tube return segment. By means of this successive evacuation, the pallets do not collide or otherwise hinder one another when exiting the individual winding stations. To avoid commingling of the cops of the old and new batches at the start of a new batch, it is necessary to remove the cops, remnant cops or tubes from their supporting pallets downstream along the tube return path. Depending upon whether the bobbin-winding machine is separate from the spinning machine which produced the cops or operates in conjunction with the spinning machine, it may be necessary in order to facilitate the start of a new batch either to have empty pallets available or to prepare pallets on which the tubes of the new batch may be placed, so that they are distinguished from those of the old batch. The latter is possible when there is a direct connection of the winder with a spinning machine that must be supplied with the same number of empty tubes as the number of cops it delivers to the bobbin-winding machine.

In the preferred embodiment of the method, the other winding stations are evacuated successively in the direction counter to the transport direction of the tube return path. After the cops and tubes are removed from their pallets at the removal location, the resulting empty pallets are conveyed from the tube return path to the cop supply path around an end of the bobbin-winding machine to an upstream end of the tube return path, and are accumulated in alignment thereat. The accumulated empty pallets are held until a predetermined time in the successive evacuation of the pallets from the winding stations at which the transport of the accumulated pallets along the tube return path will not interfere with evacuation of the winding station pallets onto the tube return path.

Advantageously, by means of the successive evacuation of the winding stations opposite to the transport direction of the tube return belt, the time for this process can be significantly shortened, because each successive winding station in sequence can already be evacuated before the preceding winding station along the tube return path has been completely cleared. Accumulation of the empty pallets at the beginning of the tube return path makes it possible to transport the pallets out of the winding stations onto the tube return path without interference by the accumulating empty pallets located in the transport loop. Therefore, the accumulated pallets are only released when they can no longer come into contact with the pallets being transported out of the winding station onto the tube return path.

In contrast to normal operation of the winder, during which pallets are transported back and forth along the distribution segment for distribution among the winding stations of the winder, during the clearance of the distribution segment pallets are preferably transported therealong only in the direction toward the first evacuated winding station. This makes it possible to execute the fastest possible clearing of the distribution segment.

In one embodiment, the selected winding station to be evacuated at one end of the distribution segment is the winding station disposed most downstream in the transport direction of the tube return belt, the successive evacuation of the other winding stations in such case being initiated at the opposite end of the bobbin-winding machine before the completion of clearing of the distribution segment.

If the winding station disposed the furthest downstream in the transport direction of the tube return path is evacuated as the first winding station, the pallets transported through this winding station reach the removal location relatively quickly to have their cops or tubes removed, which, incidentally, can be effected by hand or by means of an appropriate doffing device. If the successive evacuation of the other winding stations is begun at the opposite end of the bobbin-winding machine, this can already be effected at a point in time at which the clearing of the distribution segment has not yet been completed provided that the two transport streams of pallets do not mutually impair one another.

In the preferred embodiment, the transport system has cop preparation segments branching between the cop supply path and the distribution segment, which are used in the present method for temporarily storing empty pallets during batch changes to increase the overall pallet storage capacity of the transport system. The preparation segments are evacuated onto the cop supply path after the start of the new batch.

During the time between the end of one batch and the beginning of a new one, it can be advantageous not to guide the pallets past the cop supply device of the winder in order to be able to undertake appropriate adjustment or maintenance work within this time frame, if necessary. Thus, after the removal of cops and tubes from pallets passing the removal location, the resulting empty pallets may be diverted from the tube return path before reaching a transfer segment of the transport system which extends to the cop supply path through the cop supply device for exchanging unwound tubes for cops in normal operation.

Also, after the step of removing the cops and tubes of the previous batch from their pallets, tubes of a new batch may be placed onto the empty pallets.

BRIEF DESCRIPTION OF THE DRAWING

The single figure of the drawing, which was subdivided into FIGS. 1*a* and 1*b* due to space constraints, shows in schematic plan view a bobbin-winding machine having a transport system in accordance with a preferred embodiment of the present invention, FIGS. 1*a* and 1*b* showing the left and right ends of the machine, respectively.

DETAILED DESCRIPTION OF THE PREFERRED EMBODIMENTS

Figure 1A:
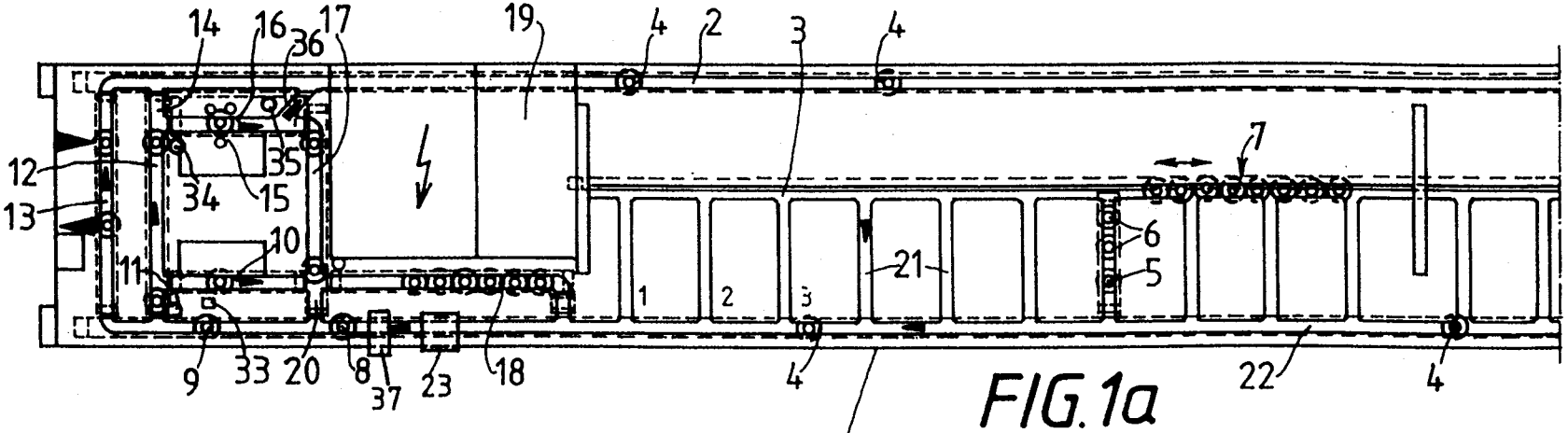

Referring now to the accompanying drawings, the bobbin-winding machine 1 has a cop and tube transport system of conveyor belts defining transport paths for yarn cops and tubes including a plurality of transport loops some of which have shared or common transport paths to some extent. Pallets 4, which have a disk-like base and an upstanding support pin or arbor to carry cops or tubes thereon in upright disposition, are transported on these transport paths. For the sake of clarity and simplicity, the cops or tubes are not shown.

A cop supply or delivery track 2 for supplying pallet-supported cops to the winding stations extends along the entire bobbin-winding machine 1. Preparation segments 25, which lead through preparation stations 26, 27, 28, branch from the cop supply track 2. Preparation of the cops in stages for subsequent yarn unwinding operation can be effected in a known manner by means of these preparation stations 26 through 28, as described in German Patent DE 39 19 542 A1.

The transport system further includes a connecting segment 24 at the end of each preparation segment 25 that supplies the cops alternatively to a cop distribution segment 3 in the form of a reversing conveyor belt extending lengthwise alongside the winding stations or back to the cop supply track 2. This connecting segment 24 is activated by the last preparation station 28, which monitors the success of cop preparation. If the cop was successfully prepared, the connecting segment 24, which may also comprise a reversing conveyor belt, directs the cop to the distribution segment 3. However, if the cop was not be properly prepared, the pallet 4 carrying it is conveyed to the cop supply track 2 by the appropriate control of the transport direction of the connecting segment 24. The cop supply track 2 conveys this pallet either to the next preparation segment 25 or around the end of the bobbin-winding machine 1 via a transfer segment 31 onto the tube return belt 22. This tube return belt 22 extends parallel to the cop supply belt 2, along the entire bobbin-winding machine 1 at the opposite side of the machine. The distribution of cops to the different preparation segments 25 is described in DE 39 19 542 A1 and thus need not be described in further detail herein.

The traveling direction of the belt forming the distribution segment 3 is reversed at predetermined time intervals to distribute the conveyed pallets carrying prepared cops onto the individual transport tracks 21 leading through the winding stations 5. Each transport track 21 provides two reserve positions 6 for the cop-supporting pallets 4 between the unwinding position of its winding station 5 and the distribution segment 3. Groups of cop-supported pallets, collectively indicated at 7, travel back and forth on the distribution segment 3, the individual pallets entering into a transport track 21 leading through a winding station 5 whenever its rearmost reserve position 6 closest to the distribution segment 3 is not occupied. Details of this operation are also described in German Patent DE 39 19 542 A1. For the sake of clarity and simplicity, the drawings show only a small proportion of the circulating pallets 4 which would travel along the transport system in actual practice. In particular, in most cases, each of the transport tracks 21 would normally be occupied by three pallets, as shown by only a single transport track 21 in the drawing.

The transport tracks at the end of the tube return belt 22, with their associated processing stations, will be described in further detail. A so-called remnant cop, i.e., one which still contains a sufficient residual quantity of yarn for further processing, is indicated at 9. This remnant cop 9 is shown to be traveling along the return belt 22 next to a residual yarn detector 33 that detects the yarn mass still present on the cop tube. This residual yarn detector controls an electromagnet 11, which acts on an iron ring encircling the base of each of the pallets 4 and diverts the respective pallet from the tube return belt 22 onto a secondary transport track 12. From this secondary transport track 12, the remnant cop 9 is diverted onto a connection segment 16, by means of an energized electromagnet 34, and delivered to a yarn end preparation device 15 that searches for the beginning of the yarn on the conical portion of the cop, regardless of its position, and places the yarn end in a disposition so that it can be located and grasped later at the winding station. A cop prepared in this manner is then conveyed again to the cop supply path 2 via a connection segment 36, onto which the pallet 4 is diverted by means of a current-supplied electromagnet 35. The preparation device 15 also has a detector that monitors the success of yarn end preparation so that, if the remnant cop 9 could not be successfully prepared, the pallet is directed onto a supply path 17 to a collection segment 18 by interrupting the supply of current to the electromagnet 35.

The residual yarn detector 33 is also operative to identify tubes having only a small residual yarn mass, as represented by the tube 8 shown traveling past an end frame 19 of the winder and to divert the pallet 4 carrying the tube 8 by means of the electromagnet 11 onto the secondary transport track 12. However, this tube 8 is diverted immediately thereafter to a tube-cleaning device 10. Another electromagnet that may also be activated by the residual yarn detector 33 can be disposed at the location of this branch from the transport track 12. The cleaned tube 8 and its pallet 4 then travel again to the tube return belt 22 via a connecting segment 20 or, if tube cleaning was not accomplished successfully, into the storage segment 18 (reference may also be made on this point to German Patent DE 39 19 542 A1).

Each tube 8 that has been completely unwound and discharged from a winding station 5 is likewise conveyed to the residual yarn detector 33 on the tube return track 22. The detector does not activate the electromagnet 11 during normal operation, so that the pallet 4 carrying the empty tube 36 is not diverted onto the secondary transport track 12 but instead travels to the end of the return path 22 whereat the tube 8 and pallet 4 are directed onto the transfer segment 13, on which the empty tube is exchanged for a cop fully wound with yarn. For this purpose a tube-doffing device and a cop donning device can be disposed adjacent one another in the transport direction. The pallet 4 then travels again with its newly supported cop onto the supply track 2 and, in the above-described manner, to a winding station of the bobbin-winding machine.

When a batch of yarn-wound cops has been completed and no further cops are conveyed onto the transport track 13, for instance when the cop delivery station formed by the cop donning device is empty, a batch change is prepared. For this operation, the pallets 4 are left in the transport system, while all cops, remnant cops or empty tubes that are still present in the transport system are removed.

These cops and tubes are removed at a removal position 23 by hand, or by means of a doffing device that can operate with grippers, for example, and the cops and tubes are deposited into available boxes or containers that are not shown. Leftover fully-wound cops can be re-used at a later time, when the same batch of yarn is being rewound.

Another electromagnet 30, operative in the same manner as described above for the electromagnet 33, is disposed at the beginning of each of the preparation segments 25 at which they branch from the cop supply path 2 for distributing the cop-supporting pallets 4 among the several preparation segments 25. For this purpose, each electromagnet 30 is in the form of a shunt connected to a respective sensor 29 that is disposed upstream thereof along the cop supply path 2 to selectively control the function of the associated downstream electromagnet 30 to divert pallets onto the associated preparation segment 25 in accordance with a preset program which is intended to assure a uniform distribution of these pallets 4 along the distribution segment 3. This operation can be effected in accordance with the example disclosed in German patent application P 42 10 815.2, and therefore, a more detailed description herein is unnecessary.

When the pallets on the transfer segment 13 receive no additional new cops from the cop donning device, the pallets are first detained in a loading position thereat for a short time, so that the still-occupied pallets can be distributed into the distribution segments 25. During this time the tube removal device disposed upstream thereof along the transfer segment 13 can also continue to function to remove empty tubes detected by the residual yarn detector 33. In this manner, it is possible to begin removal of the tubes having residual yarn thereon at the removal position 23 along the return path 22 only after the last unwound empty tubes 8 have passed the removal position 23.

To accomplish this batch-changing operation, all of the winding stations must be shut off at this time, which can be controlled by means of a step-by-step sequence programmed in a central control system of the bobbin-winding machine, or by hand with appropriate operating elements on the end frame 19. At this time, the conveyance of the pallets 4 on the distribution segment 3 by its reversible conveyor belt is switched to a continuous transport direction that corresponds to the transport direction of the tube return belt 22 and, optionally, it is also possible to increase the belt's transport speed, for purposes of clearing the distribution segment 3. To facilitate the clearing of the distribution segment 3, the first winding station, disposed most closely adjacent the end frame 19 and indicated by the number "1," is evacuated. For example, as described in German Patent DE 38 43 553 A1, a lengthwise-divided cuff disposed in the unwinding position 5, may be opened, by means of which a conveyor belt of the transport track 21 that runs under this cuff conveys the pallets 4 arriving at the corresponding end of the distribution segment 3 through this winding station directly to the tube return belt 22.

After the start of cop and remnant cop removal at the removal position 23, the electromagnet 11 is continuously energized, whereby the empty pallets 4' thusly produced are all diverted onto the secondary transport track 12 and do not reach the transport track 13. Because the electromagnet 34 is simultaneously deenergized, these empty pallets 4' travel directly to the cop supply path 2 via a terminal end portion 14 of the secondary transport track 12.

Before these empty pallets 4' reach the first-branching preparation segment 25, the electromagnets 30 are switched to a deenergized state so that the empty pallets 4' travel undiverted to the end of the bobbin-winding machine, and travel therefrom onto the transfer segment 31 which then terminates at the tube return path 22. A retaining arm 32 is disposed in advance of the last winding station, indicated here with the number "60," to successively detain and accumulate the empty pallets 4' in alignment along the transfer segment 31.

Figure 1B:
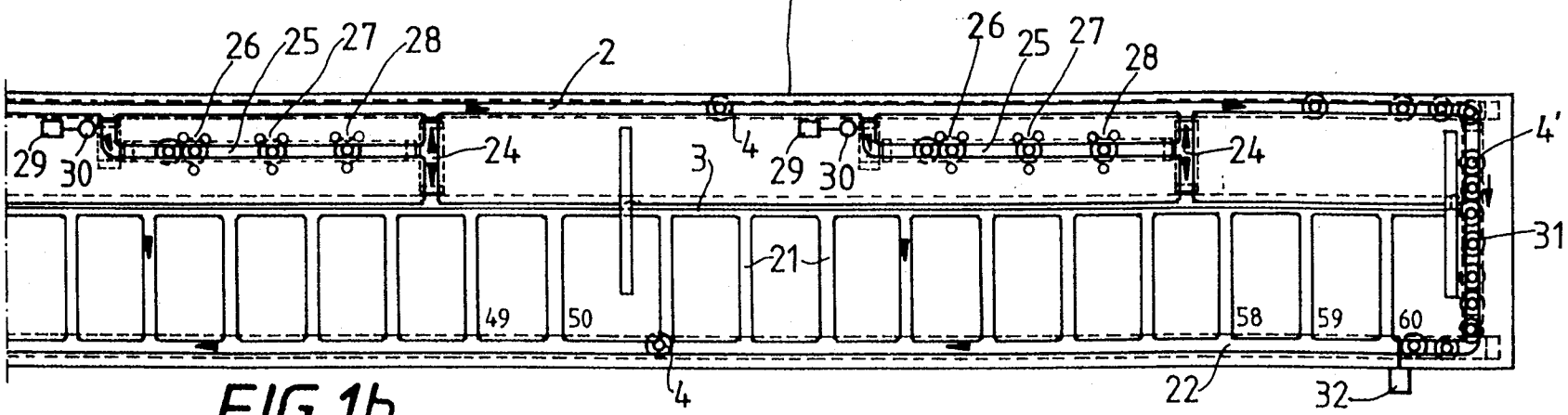

In the representative embodiment of the invention shown in the accompanying drawings, a winding machine having sixty adjacent winding stations is assumed, but as will be understood, not all sixty winding stations nor all of the preparation segments 25 of the bobbin-winding machine are shown, despite the division of the drawings into FIGS. 1*a* and 1*b*. Moreover, it should be understood that the arrangement of the illustrated preparation segments 25 in the last two sections of the bobbin-winding machine with each encompassing ten winding stations is shown only by way of example.

Upon evacuation of the pallets 4 from the distribution segment 3, the winding stations are evacuated successively in the direction of travel of the tube return path 22, beginning with the endmost winding station number 60, which can be initiated before the distribution segment 3 is cleared provided that the first pallet 4 exiting the winding station 60 reaches the first evacuated winding station 1 only after the exit of the last pallet from the distribution segment 3.

As an alternative, it is also possible to execute the successive evacuation of the winding stations in the reverse order. In this case, winding station evacuation can first be initiated only when the distribution segment 3 is completely cleared, in order to avoid a collision of the pallets on the return path 22. However, the advantage in this case is that the evacuation of each respectively succeeding winding station can begin before the previous winding station is cleared because the portion of the tube return path 22 between the individual winding stations is additionally free of pallets.

Advantageously, after clearing of the distribution segment 3, the electromagnets 30 are again energized for a specific period of time to cause the empty pallets 4' to be diverted into the preparation segments 25, by means of which the overall capacity of the transport system for storing pallets is increased. During this time, the transport belts at the connecting sections 24 are not operated, whereby the empty pallets 4' accumulate in the preparation segment 25 without being transported further.

The retaining arm 32 is withdrawn at a point in time at which the first empty pallet 4' in the accumulated alignment of pallets, when permitted to travel along the return belt 22, can no longer reach or hinder the last pallet 4 to be evacuated from the winding stations 5.

After the doffing of the cop from the last cop-carrying pallet 4 to reach the removal position 23, the previously emptied pallets 4' held by the retaining arm 32 arrive at this point.

As soon as cops from the new batch are available, the electromagnet 11 is deenergized again, so that the empty pallets 4', on which the residual yarn detector 33 detects no residual yarn, are permitted to reach the transfer belt 13 and its associated cop donning station. Because the cop supply path 2 was re-cleared through the opening of the retaining arm 32, the pallets 4 mounted with the new cops can immediately be supplied to the bobbin-winding machine, as in normal operation. Prior to this time, the transport belts disposed on the connecting sections 24 are operated in the direction toward the cop supply path 2 for a sufficient period of time to clear the preparation segments 25 of empty pallets 4' so as to be ready to receive the new cops. These empty pallets 4' also circulate to the tube return path 22 around the bobbin-winding machine via the transfer segment 31.

While the above-described exemplary embodiment of this invention has been described with respect to a bobbin-winding machine that is separate from a spinning machine, wherein there is no direct requirement for the number of empty tubes to correspond to the delivery of cops, it is to be understood that the invention is also applicable to a bobbin winding machine which operates directly in conjunction with a spinning machine, as will be explained briefly below.

The transfer track 13 in such case is a common transport segment of the transport loops for the pallets on the respective sides of the spinning machine and the bobbin-winding machine, as they are known from German Patent DE 40 34 824 A1, for example. As a result, the appropriate number of empty tubes must be available for transferring the cops of the new batch from the pallets on the side of the spinning machine onto the pallets on the side of the bobbin-winding machine. Accordingly, in FIG. 1*a* a tube placement position is indicated at 37 at which the empty pallets 4' after the removal of the cops or remnant cops at the removal location 23, are loaded with the tubes of the new batch by hand or with a known tube donning device. In this case, it is absolutely imperative that the electromagnet 11 be constantly activated so that the pallets with the new tubes cannot reach the transfer segment 13 until the appropriate time for exchange of tubes with the cops of the new batch to take place. In cases where the tubes of the new batch agree with the tubes of the old batch, there is also the option not to remove empty tubes of the old batch, so that these pallets do not have to be reloaded.

Moreover, because it is known to use sensors to identify both empty pallets and pallets equipped with empty tubes, it is also contemplated that the sensors 29 are correspondingly suitable for such purpose.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method for operating an automatic bobbin-winding machine during batch changing operations, wherein the bobbin winding machine has a plurality of winding stations mid a transport system for conveying cops and tubes to and from the winding stations while mounted upstanding on pallets, the transport system including a plurality of transport loops having partially common transport paths, the transport system including a cop supply path, a cop distribution segment extending along the winding stations, and a tube return path, the method comprising the steps of, when the bobbin-winding machine has exhausted its supply of cops at the end of winding a batch of cops, stopping the winding operation and, while maintaining the pallets in the transport system of the bobbin-winding machine, evacuating onto the tube return path all pallets from a selected winding station at one end of the distribution segment, clearing the distribution segment of pallets by transporting the pallets through the evacuated winding station onto the tube return path, evacuating onto the tube return path the other winding stations successively of all the pallets thereat, at a removal location downstream of the tube return path removing the cops or tubes from all pallets as the pallets are transported past the removal location, and conveying from the tube return path to the cop supply path the empty pallets from which the cops or tubes were removed.

2. The method as defined in claim 1, wherein the tube return path is operative in a predetermined transport direction extending successively along the winding stations and the step of successively evacuating the other winding stations includes evacuating the winding stations successively in the direction counter to the transport direction of the tube return path.

3. The method as defined in claim 1, wherein the step of conveying empty pallets from the tube return path to the cop supply path comprises directing the empty pallets around an end of the bobbin-winding machine to an upstream end of the tube return path, accumulating the empty pallets in alignment with one another thereat, and holding the accumulated pallets until a predetermined time in the successive evacuation of the pallets from the winding stations at which the transport of the accumulated pallets along the tube return path will not interfere with evacuation of the winding station pallets onto the tube return path.

4. The method as defined by claim 1, wherein pallets are conveyed reversibly in opposite directions along the distribution segment and, during the step of clearing of the distribution segment, transporting pallets therealong only in the direction toward the first evacuated winding station.

5. The method as defined by claim 1, wherein the tube return path is operative in a predetermined transport direction extending successively along the winding stations and the step of evacuating a selected winding station at one end of the distribution segment comprises evacuating the winding station disposed most downstream in the transport direction of the tube return belt, and the step of successively evacuating the other winding stations is initiated at the opposite end of the bobbin-winding machine before the completion of clearing of the distribution segment.

6. The method as defined by claim 1, wherein the transport system further comprises preparation segments between the cop supply path and the distribution segment, the method further comprising storing empty pallets along the preparation segments during batch changes and evacuating the preparation segments onto the cop supply path after the start of the new batch.

7. The method as defined by claim 1, wherein the step of removing cops and tubes from all pallets comprises diverting empty pallets onto the tube return path before reaching a transfer segment extending to the cop supply path along which unwound tubes are exchanged for cops.

8. The method as defined by claim 1, wherein, after the step of removing the cops and tubes of the previous batch from the pallets, placing tubes of a new batch onto the empty pallets.

* * * * *